US010352610B2

(12) United States Patent
Miller et al.

(10) Patent No.: US 10,352,610 B2
(45) Date of Patent: Jul. 16, 2019

(54) REFRIGERATOR APPLIANCE

(71) Applicant: Haier US Appliance Solutions, Inc., Wilmington, DE (US)

(72) Inventors: Charles Benjamin Miller, Louisville, KY (US); Bradley Nicholas Gilkey, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 13 days.

(21) Appl. No.: 15/716,575

(22) Filed: Sep. 27, 2017

(65) Prior Publication Data

US 2019/0093938 A1 Mar. 28, 2019

(51) Int. Cl.

| | |
|---|---|
| ***F25D 17/06*** | (2006.01) |
| ***F25C 5/18*** | (2018.01) |
| ***F25C 5/00*** | (2018.01) |
| ***F25C 5/182*** | (2018.01) |
| ***F25C 5/20*** | (2018.01) |
| *F25C 1/04* | (2018.01) |

(52) U.S. Cl.

CPC ..... *F25D 17/065* (2013.01); *F25C 5/182* (2013.01); *F25C 5/22* (2018.01); *F25C 1/04* (2013.01); *F25C 2400/10* (2013.01); *F25D 2317/061* (2013.01)

(58) Field of Classification Search

CPC .... F25D 17/065; F25D 2317/061; F25C 5/22; F25C 5/182; F25C 1/04; F25C 2400/10

See application file for complete search history.

(56) References Cited

U.S. PATENT DOCUMENTS

| | | | | |
|---|---|---|---|---|
| 7,222,498 | B2 | 5/2007 | Lee et al. | |
| 7,392,665 | B2 | 7/2008 | Lee et al. | |
| 8,616,018 | B2 | 12/2013 | Jeong et al. | |
| 9,377,233 | B2 * | 6/2016 | Boehringer | F25D 23/006 |
| 9,383,128 | B2 | 7/2016 | Boarman et al. | |
| 9,625,202 | B2 | 4/2017 | Lopes et al. | |
| 2008/0092574 | A1 * | 4/2008 | Doberstein | F25C 1/04 62/233 |
| 2016/0201967 | A1 * | 7/2016 | Mitchell | F25D 29/005 62/135 |
| 2017/0205132 | A1 * | 7/2017 | Nuss | F25D 17/065 |

FOREIGN PATENT DOCUMENTS

| | | |
|---|---|---|
| CN | 206192007 U | 5/2017 |

* cited by examiner

*Primary Examiner* — Melvin Jones

(74) *Attorney, Agent, or Firm* — Dority & Manning, P.A.

(57) ABSTRACT

A refrigerator appliance is generally provided herein. The refrigerator appliance may include a cabinet, an icebox liner, an icemaker, an ice bin, and a circulation duct. The cabinet may define a one or more chilled chambers. The icebox liner may be attached to the cabinet. The icebox liner may define a sub-compartment in which the icemaker may be mounted. The ice bin may define a storage volume within the sub-compartment to receive ice from the icemaker. The circulation duct may extend within the sub-compartment in conductive thermal communication with the icemaker. The circulation duct may define an air passage in fluid communication with one of the chilled chambers and fluid isolation from the storage volume.

20 Claims, 9 Drawing Sheets

REFRIGERATOR APPLIANCE

FIELD OF THE INVENTION

The present subject matter relates generally to refrigeration appliances and more particularly to refrigeration appliances including features for making ice.

BACKGROUND OF THE INVENTION

Certain appliances, such as refrigerator appliances, generally include an icemaker. In order to produce ice, liquid water is directed to the icemaker and frozen. After being frozen, ice may be stored within a storage bin within the appliance. In order to ensure ice is formed and/or remains in a frozen state, the icemaker and bin may be mounted within a chilled portion of the appliance. For instance, some conventional appliances provide an icemaker and storage bin within a freezer compartment. Other conventional appliances provide the icemaker and storage bin within a separate icebox compartment (e.g., within a door of the appliance). In order to maintain efficient operation, these conventional appliances generally provide an air circulation system to continuously circulate air within the icebox compartment with air within the freezer compartment.

Certain drawbacks exist with these conventional appliances. For instance, conventional appliances generally maintain the icemaker and the storage bin at the same temperature. Specifically, some such appliances circulate the same volume air over the icemaker and the storage bin. Ice within the storage bin is thus generally maintained at the same temperature as the icemaker. However, the low temperature demands of an icemaker are often much greater than the demands of a storage bin. As a result, the air within an icebox compartment is generally maintained at a significantly lower temperature than would otherwise be necessary or desirable for storing ice. Moreover, conventional appliances may require increased insulation about the icebox and storage bin to ensure the low temperatures of the icebox are maintained. In particular, the low temperatures of the icebox must typically be maintained in such a way that other portions of the appliance, such as a fresh food chamber, are not significantly influenced. These issues may cause the appliance to operate inefficiently, especially for ice making and ice storing operations. The increased need for insulation may also reduce the amount of available space for storage within the refrigerator appliance.

In addition to inefficient ice making and ice storing operations, conventional appliances may risk tainting the flavor or texture of ice being stored (e.g., in a storage bin). Foul or unpleasant odors (e.g., within a freezer) may be circulated to the icemaker and/or storage bin. Over time, the odors within may be absorbed by the ice within the icebox.

In turn, it would be advantageous to provide a refrigerator appliance having features for addressing one or more of the above-described drawbacks.

BRIEF DESCRIPTION OF THE INVENTION

Aspects and advantages of the invention will be set forth in part in the following description, or may be obvious from the description, or may be learned through practice of the invention.

In one aspect of the present disclosure, a refrigerator appliance is provided. The refrigerator appliance may include a cabinet, an icebox liner, an icemaker, an ice bin, and a circulation duct. The cabinet may define a first chilled chamber and a second chilled chamber spaced apart from the first chilled chamber. The icebox liner may be attached to the cabinet. The icebox liner may define a sub-compartment within the first chilled chamber. The icemaker may be mounted within the sub-compartment. The ice bin may define a storage volume within the sub-compartment to receive ice from the icemaker. The circulation duct may extend within the sub-compartment in conductive thermal communication with the icemaker. The circulation duct may define an air passage in fluid communication with the second chilled chamber and fluid isolation from the storage volume.

In another aspect of the present disclosure, a refrigerator appliance is provided. The refrigerator appliance may include a cabinet, an evaporator, an icebox liner, an icemaker, an ice bin, and a circulation duct. The cabinet may define a fresh food chamber and a chilled evaporator chamber. The evaporator may be mounted within the chilled evaporator chamber. The icebox liner may be attached to the cabinet at the fresh food chamber, the icebox liner defining a sub-compartment. The icemaker may be mounted within the sub-compartment. The ice bin may define a storage volume within the sub-compartment to receive ice from the icemaker. The circulation duct may extend within the sub-compartment in conductive thermal communication with the icemaker. The circulation duct may define an air passage in fluid communication with the chilled evaporator chamber and fluid isolation from the storage volume.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
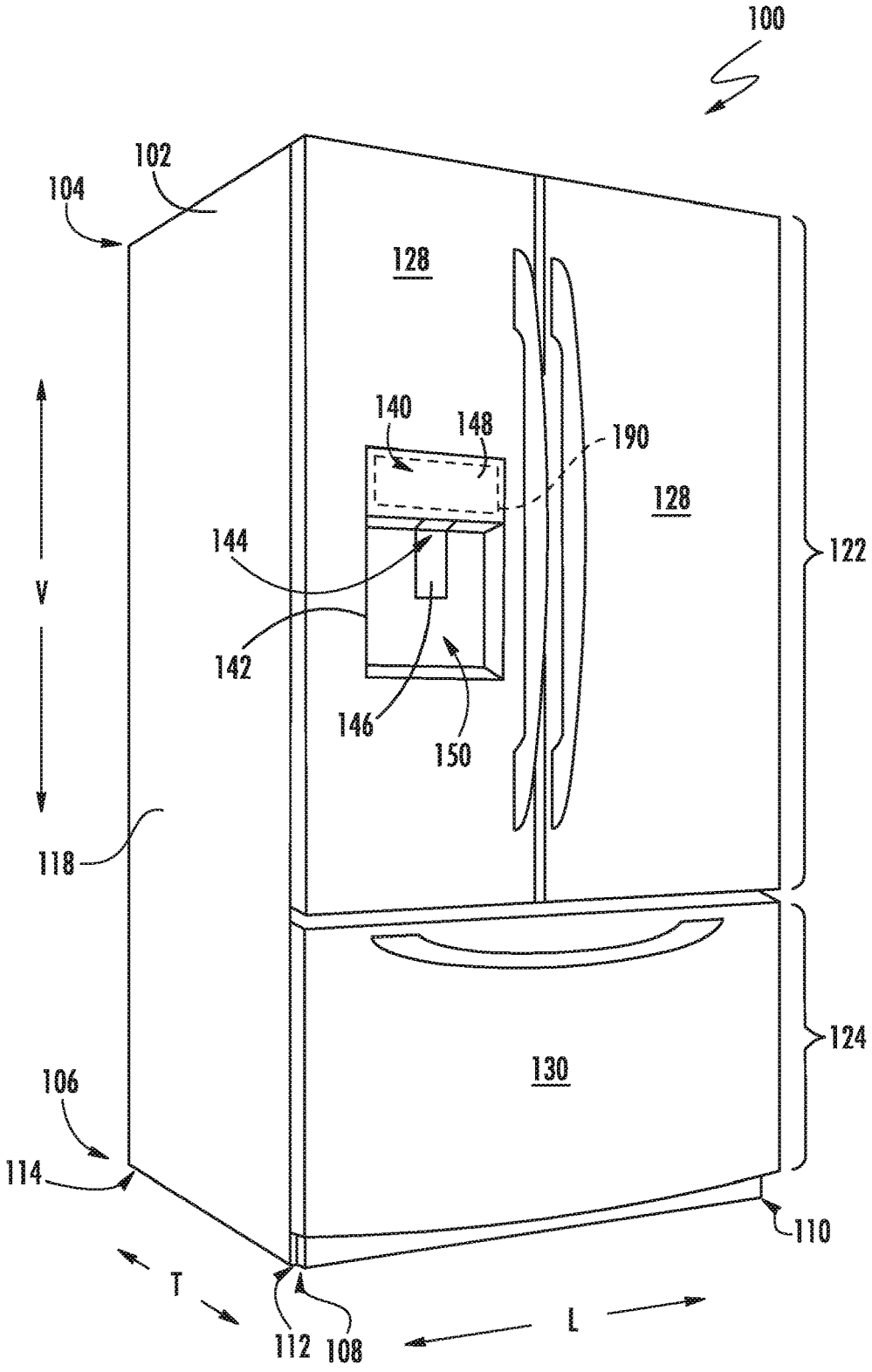
FIG. 1 provides a perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, a refrigerator appliance may be provided in some aspects of the present disclosure. The refrigerator appliance can include multiple separate chambers, such as a fresh food chamber and a freezer chamber. An icebox compartment for an icemaker can also be included. For instance, an icebox compartment can be defined in a door that permits access to the fresh food chamber. A separate circulation duct can also be included to exchange chilled air with the icebox compartment. The circulation duct may extend through the icebox compartment to conduct heat from an icemaker while being sealed off from a storage bin within the icebox compartment. In turn, although air may circulate through the circulation duct, it may be prevented from mixing with air and ice within the storage bin.

Figure 2:
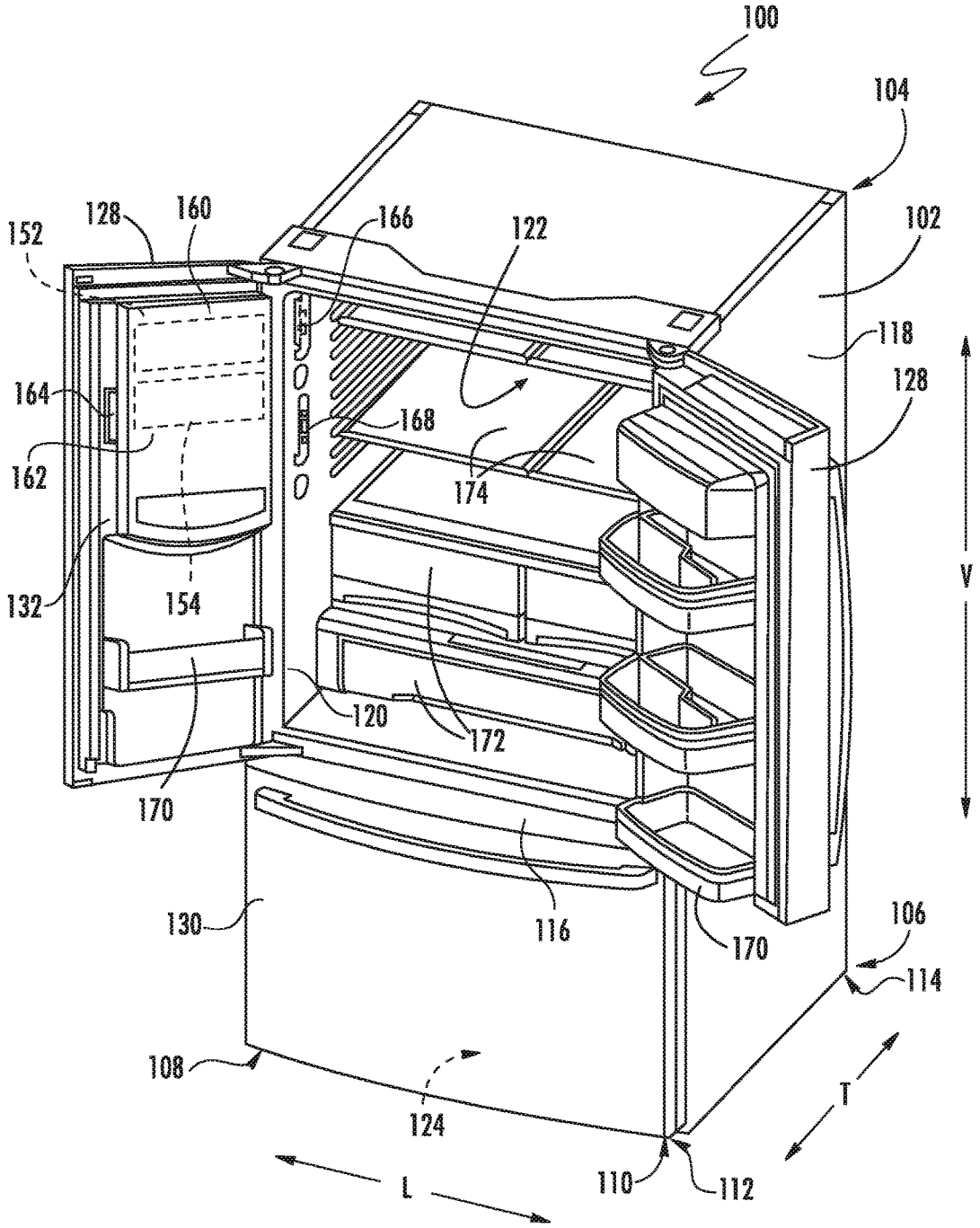
FIG. 2 provides a perspective view of the exemplary refrigerator appliance shown in FIG. 1, wherein a refrigerator door is in an open position according to an exemplary embodiments of the present disclosure.

Turning to the figures, FIGS. 1 and 2 illustrate perspective views of an exemplary appliance (e.g., a refrigerator appliance 100) that includes an ice making feature or system. Refrigerator appliance 100 includes a housing or cabinet 102 having an outer liner 118. As shown, cabinet generally extends between a top 104 and a bottom 106 along a vertical direction V, between a first side 108 and a second side 110 along a lateral direction L, and between a front side 112 and a rear side 114 along a transverse direction T. Each of the vertical direction V, lateral direction L, and transverse direction T are mutually perpendicular to one another and form an orthogonal direction system.

As shown, cabinet 102 generally defines a plurality of chilled chambers for receipt of food items for storage. In particular, cabinet 102 defines a fresh food chamber 122 (e.g., first chamber) proximal to adjacent top 104 of cabinet 102 and a freezer chamber 124 (e.g., second chamber) arranged proximal to 106 of cabinet 102. As such, refrigerator appliance 100 is generally referred to as a bottom mount refrigerator. It is recognized, however, that the benefits of the present disclosure apply to other types and styles of refrigerator appliances such as, for example, a top mount refrigerator appliance or a side-by-side style refrigerator appliance. Consequently, the description set forth herein is for illustrative purposes only and is not intended to be limiting in any aspect to any particular refrigerator chamber configuration.

Generally, an internal liner 120 defines fresh food chamber 122 and/or freezer chamber 124. Specifically, an inner surface of internal liner 120 may define one or both of fresh food chamber 122 and freezer chamber 124. An opposite outer surface of internal liner 120 may face away from inner surface and the respective fresh food chamber 122 or freezer chamber 124.

Internal liner 120 may be formed from a single continuous integral component or, alternatively, from multiple connected pieces. According to the illustrated embodiment, various storage components are mounted within fresh food chamber 122 to facilitate storage of food items therein as will be understood by those skilled in the art. In particular, the storage components include bins 170, drawers 172, and shelves 174 that are mounted within fresh food chamber 122. Bins 170, drawers 172, and shelves 174 are positioned to receive of food items (e.g., beverages and/or solid food items) and may assist with organizing such food items. As an example, drawers 172 can receive fresh food items (e.g., vegetables, fruits, and/or cheeses) and increase the useful life of such fresh food items. In some embodiments, a lateral mullion 116 is positioned within cabinet 102 and separating freezer chamber 124 and the fresh food chamber 122 along a vertical direction V.

Refrigerator doors 128 are rotatably hinged to an edge of cabinet 102 for selectively accessing fresh food chamber 122 and extending across at least a portion of fresh food chamber 122. In addition, a freezer door 130 is arranged below refrigerator doors 128 for selectively accessing freezer chamber 124 and extending across at least a portion of freezer chamber 124. Freezer door 130 is coupled to a freezer drawer (not shown) slidably mounted within freezer chamber 124. Refrigerator doors 128 and freezer door 130 are each shown in the closed position in FIG. 1 (i.e., a first closed position corresponding to doors 128, and a second closed position corresponding to door 130).

Refrigerator appliance 100 also includes a delivery assembly 140 for delivering or dispensing liquid water and/or ice. Delivery assembly 140 includes a dispenser 142 positioned on or mounted to an exterior portion of refrigerator appliance 100 (e.g., on one of refrigerator doors 128). Dispenser 142 includes a discharging outlet 144 for accessing ice and liquid water. An actuating mechanism 146, shown as a paddle, is mounted below discharging outlet 144 for operating dispenser 142. In alternative example embodiments, any suitable actuating mechanism may be used to operate dispenser 142. For example, dispenser 142 can include a sensor (such as an ultrasonic sensor) or a button rather than the paddle. A user interface panel 148 is provided for directing (e.g., selecting) the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open refrigerator doors 128. In exemplary embodiments, dispenser recess 150 is positioned at a level that approximates the chest level of a user. During certain operations, the dispensing assembly 140 may receive ice from an icemaker 152 mounted in a sub-compartment of the fresh food chamber 122, as described below.

Operation of the refrigerator appliance 100 can be generally controlled or regulated by a controller 190. In some embodiments, controller 190 is operably coupled (e.g., electrically coupled or wirelessly coupled) to user interface panel 148 and/or various other components. In some such embodiments, user interface panel 148 provides selections for user manipulation of the operation of refrigerator appliance 100. As an example, user interface panel 148 may provide for selections between whole or crushed ice, chilled water, and/or specific modes of operation. In response to one or more input signals (e.g., from user manipulation of user interface panel 148 and/or one or more sensor signals), controller 190 may operate various components of the refrigerator appliance 100 according to the current mode of operation.

Controller 190 may include a memory (e.g., non-transitory storage media) and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In some embodiments, the processor executes programming instructions stored in memory. For certain embodiments, the instructions include a software package configured to operate appliance 100 and, for example, execute an operation routine. The memory may be a separate component from the processor or may be included onboard within the processor. Alternatively, controller 190 may be constructed without using a microprocessor (e.g., using a combination of discrete analog and/or digital logic circuitry, such as switches, amplifiers, integrators, comparators, flip-flops, AND gates, and the like) to perform control functionality instead of relying upon software.

Controller 190, or portions thereof, may be positioned in a variety of locations throughout refrigerator appliance 100. In example embodiments, controller 190 is located within the user interface panel 148. In other embodiments, the controller 190 may be positioned at any suitable location within refrigerator appliance 100, such as for example within the fresh food chamber 122, a freezer door 130, etc. Input/output (i.e., "I/O") signals may be routed between controller 190 and various operational components of refrigerator appliance 100. For example, user interface panel 148 may be operably coupled to controller 190 via one or more signal lines or shared communication busses.

Figure 6:
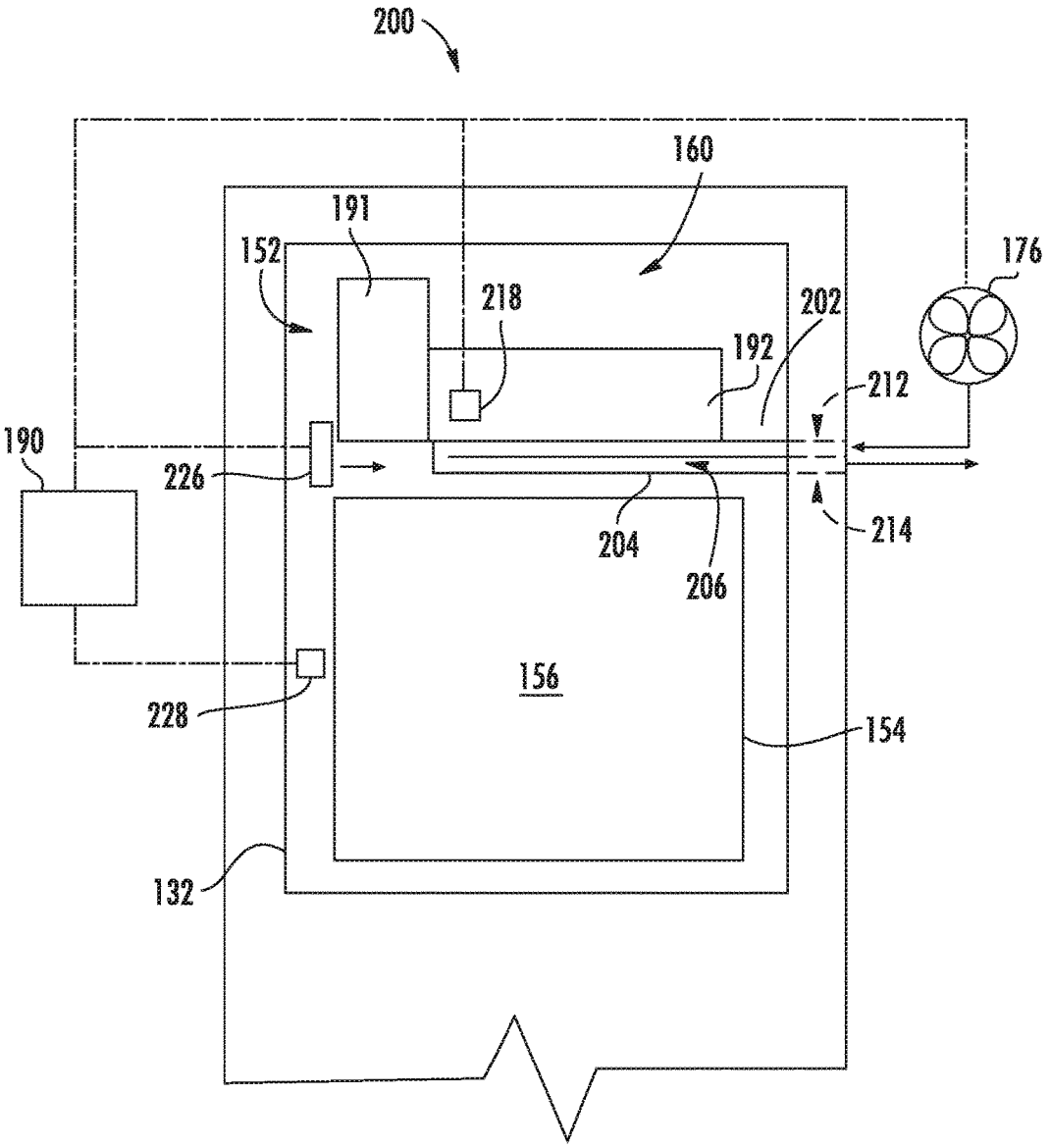
FIG. 6 provides a schematic view of the exemplary cooling system of FIG. 4.
Figure 7:
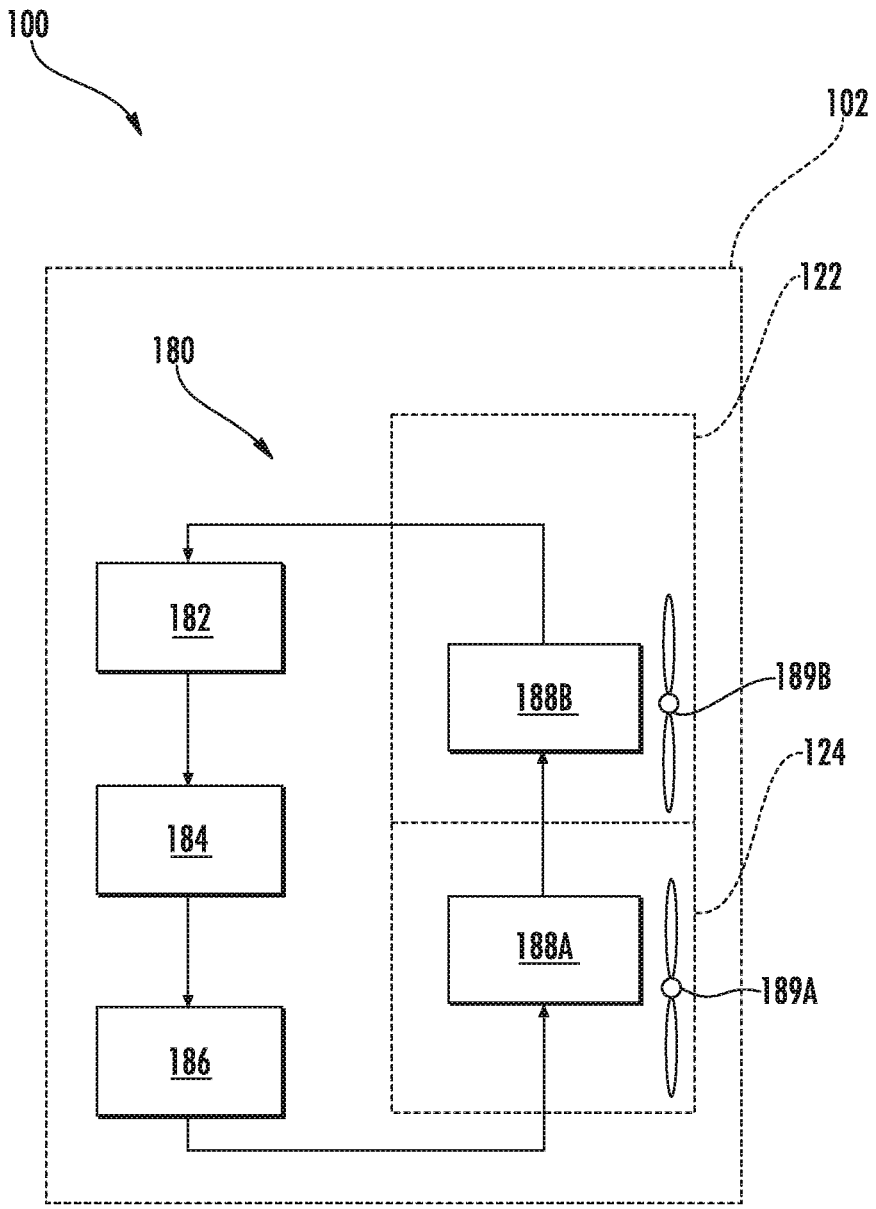
FIG. 7 provides a schematic view of a refrigerator appliance, including a sealed cooling system, according to exemplary embodiments of the present disclosure.

As illustrated, controller 190 may be operably coupled to the various components of dispensing assembly 140 and may control operation of the various components, such an icemaker 152, temperature sensors 218 and 228, and fans 176, 228, 238 (see FIGS. 3, 6, 8, and 9), as well as one or more components of a sealed cooled system 180 (see FIG. 7). For example, the various valves, switches, compressors, etc. may be actuatable based on commands from the controller 190. As discussed, interface panel 148 may additionally be operably coupled to the controller 190. Thus, the various operations may occur based on user input or automatically through controller 190 instruction.

Turning briefly to FIG. 7, a schematic view of certain components of a sealed cooling system 180 for refrigerator appliance 100 is provided. As may be seen in FIG. 7, refrigerator appliance 100 includes a sealed cooling system 180 for executing a vapor compression cycle for cooling air within refrigerator appliance 100 (e.g., within fresh food chamber 122 and freezer chamber 124). Sealed cooling system 180 includes a compressor 182, a condenser 184, an expansion device 186, and one or more evaporators 188A, 188B connected in fluid series and charged with a refrigerant. As will be understood by those skilled in the art, sealed cooling system 180 may include additional or fewer components. For example, sealed cooling system 180 may include only a single evaporator (e.g., mounted within fresh food chamber 122 or freezer chamber 124) or multiple discrete evaporators positioned separate locations within cabinet 102.

Within sealed cooling system 180, gaseous refrigerant flows into compressor 182, which operates to increase the pressure of the refrigerant. This compression of the refrigerant raises its temperature, which is lowered by passing the gaseous refrigerant through condenser 184. Within condenser 184, heat exchange (e.g., with ambient air) takes place so as to cool the refrigerant and cause the refrigerant to condense to a liquid state.

Expansion device 186 (e.g., a valve, capillary tube, or other restriction device) receives liquid refrigerant from condenser 184. From expansion device 186, the liquid refrigerant enters evaporator 188A and/or evaporator 188B. In some embodiments, such as the embodiment of FIG. 7, one evaporator 188A is positioned within freezer chamber 124 while another evaporator 188B is positioned within fresh food chamber 122. Upon exiting expansion device 186 and entering evaporator(s) 188A, 188B, the liquid refrigerant drops in pressure and vaporizes. Due to the pressure drop and phase change of the refrigerant, evaporators 188A, 188B are cool relative to freezer and fresh food chambers 124 and 122 of refrigerator appliance 100. As such, cooled air is produced and refrigerates freezer and fresh food chambers 124 and 122 of refrigerator appliance 100. Thus, evaporators 188A, 188B are heat exchangers which transfer heat from air passing over evaporators 188A, 188B to refrigerant flowing through evaporators 188A, 188B. In some embodiments, an air handler 189A or 189B, such as a fan or blower, is provided adjacent to one or more of evaporators 188A, 188B. For instance, air handler 189A may be provided within freezer chamber 124 to motivate air across evaporator 188A. Additionally or alternatively, air handler 189B may be provided within fresh food chamber 122 to motivate air across evaporator 188B.

Returning to FIG. 2, a perspective view is provided of refrigerator appliance 100 shown with refrigerator doors 128 in the open position. As shown, a secondary liner (e.g., icebox liner 132) defining a sub-compartment (e.g., icebox compartment 160) is attached (e.g., mechanically connected directly or indirectly) to cabinet 102. For instance, in some embodiments, at least one door 128 includes icebox liner 132 positioned thereon. In turn, icebox compartment 160 is defined within one of doors 128. In some such embodiments, icebox compartment 160 extends into fresh food chamber 122 when refrigerator door 128 is in the closed position. Although icebox compartment 160 is shown in door 128, additional or alternative embodiments may include an icebox compartment defined at another portion of refrigerator appliance 100 (e.g., within door 130, fixed within freezer chamber 124, or fixed within fresh food chamber 122). An ice making assembly or icemaker 152 may be positioned or mounted within icebox compartment 160. Ice may be supplied to dispenser recess 150 (FIG. 1) from the icemaker 152 in icebox compartment 160 on a back side of refrigerator door 128.

An access door (e.g., icebox door 162) may be hinged to icebox compartment 160 to selectively cover or permit access to opening of icebox compartment 160. When refrigerator door 128 and icebox door 162 are both closed, icebox door 162 thus seals icebox compartment 160 from fresh food chamber 122. Any manner of suitable latch 164 is provided with icebox compartment 160 to maintain icebox door 162 in a closed position. As an example, latch 164 may be actuated by a consumer in order to open icebox door 162 for providing access into icebox compartment 160. Icebox door 162 can also assist with insulating icebox compartment 160 (e.g., by thermally isolating or insulating icebox compartment 160 from fresh food chamber 122). As will be described in detail below, a circulation duct 202 (FIG. 3) within icebox compartment 160 may receive cooling air from a chilled air supply duct 166 and a chilled air return duct 168 positioned on a side portion of cabinet 102 of refrigerator appliance 100 (e.g., at least partially enclosed between outer liner 118 and internal liner 120). In this manner, the supply duct 166 and return duct 168 may recirculate chilled air from a suitable sealed cooling system (e.g., air within or in communication with freezer chamber 124 and/or evaporator 188A—FIG. 3) and through icebox compartment 160. An air handler (FIG. 3), such as a passage blower or fan 176, may be provided to motivate and recirculate air. As an example, passage fan 176 can direct chilled air from an evaporator 188A (FIGS. 3 and 7) of a sealed system 180 (FIG. 7) through a chilled air supply duct 166 to compartment 160.

In some embodiments, one or more of an icemaker 152 and ice bucket or storage bin 154 are provided within icebox compartment 160. Icemaker 152 may be any suitable assembly for generating ice from liquid water, such as a rigid cube, soft-ice, or nugget ice making assembly. Ice storage bin 154 defines a storage volume 156 that may be positioned to receive and/or store ice from icemaker 152. In some embodiments, ice storage bin 154 is positioned below icemaker 152 and receives ice therefrom. For instance, an ice chute (not pictured) may be positioned adjacent to icemaker 152 to direct ice from icemaker 152 to the storage volume 156 defined by ice bin 154. From ice storage bin 154, the ice can enter delivery assembly 140 and be accessed by a user. Optionally, ice storage bin 154 may be selectively removable from icebox compartment 160, thereby permitting movement of storage bin 154 outside of icebox compartment 160 and/or appliance 100 for access to the storage volume 156.

Figure 3:
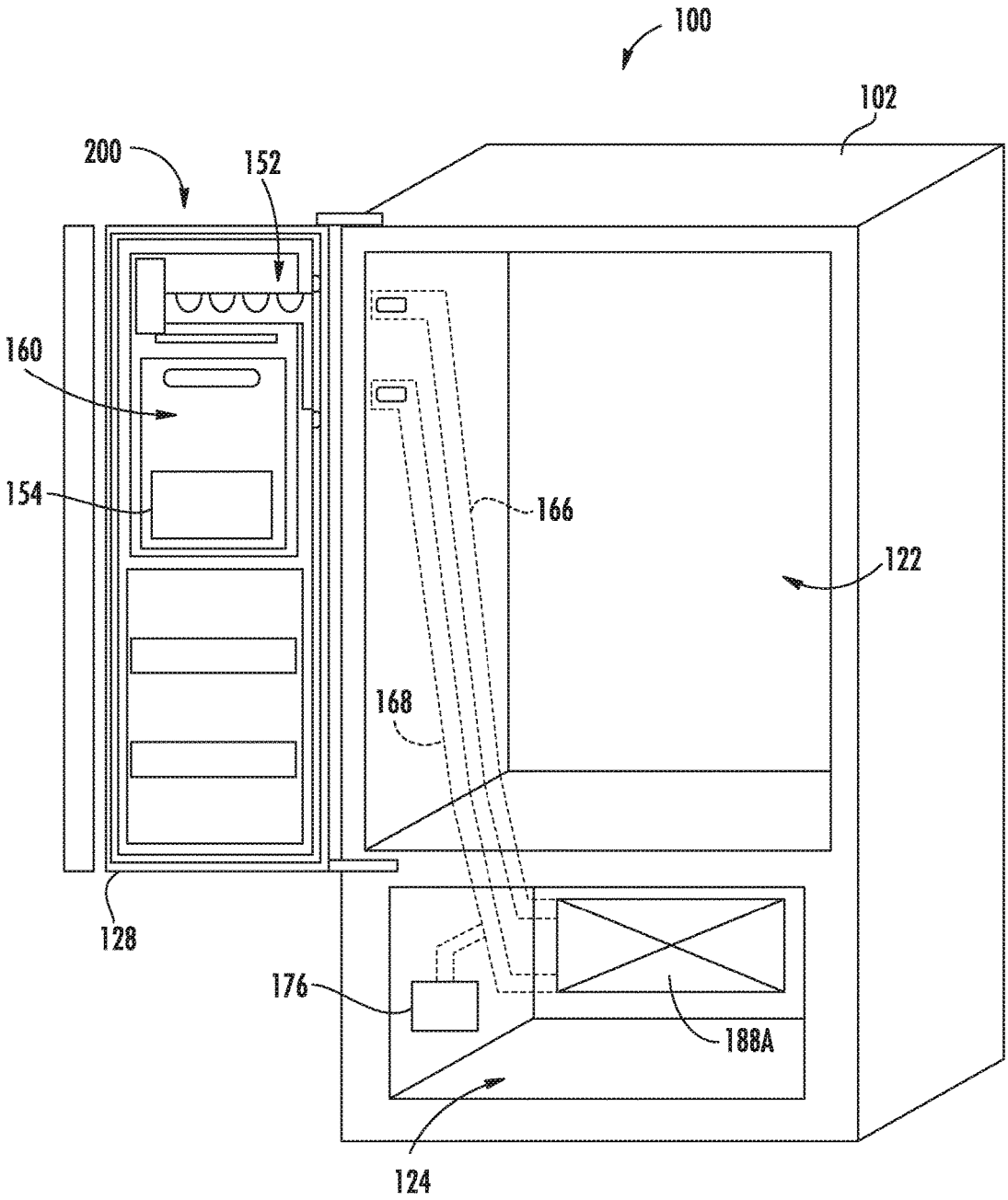
FIG. 3 provides a partial schematic view of a cooling system in a refrigerator door of the exemplary refrigerator appliance of FIG. 1 according to exemplary embodiments of the present subject disclosure.
Figure 4:
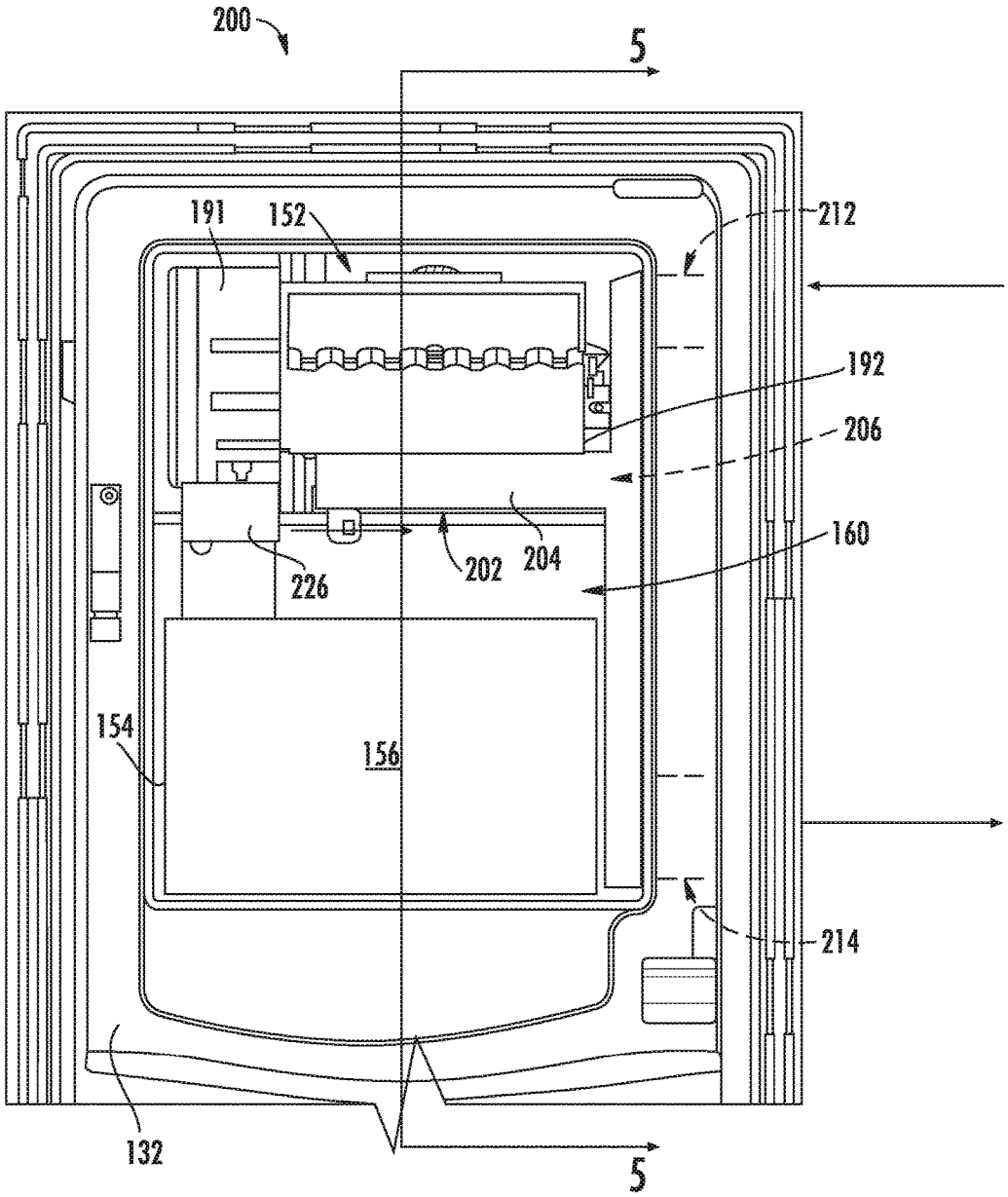
FIG. 4 provides a magnified perspective view of a cooling system in a refrigerator door of the exemplary refrigerator appliance of FIG. 1 according to exemplary embodiments of the present disclosure.

Turning now to FIGS. 3 and 4, various schematic views of refrigerator appliance 100 are illustrated. In particular, a cooling system 200 in thermal communication with icebox compartment 160 is shown. Optionally, fresh food chamber 122 may be fluidly isolated from freezer chamber 124. For instance, both chamber 122, 124 may be isolated such that no air is exchanged between chambers 122, 124 when one or both of doors 128, 130 (FIG. 2) are closed. Alternatively, a separate duct or circulation system may be provided to selectively direct chilled air from freezer chamber 124 to fresh food chamber 122 (e.g., as directed by controller 190).

As noted above, the icebox liner 132 may generally define icebox compartment 160, for instance, on door 128 or another suitable location within cabinet 102. In certain embodiments, icebox compartment 160 is positioned within fresh food chamber 122 when door 128 is in the closed position. When doors 128 and 130 (FIG. 2) are closed, icebox compartment 160, and in particular storage volume 156 may be further isolated from fresh food chamber 122 and freezer chamber 124. In turn, air may be preventing from flowing between storage volume 156 and freezer chamber 124 or fresh food chamber 122. Advantageously, odors within the chambers 122, 124 may thus be prevented from affecting the smell or flavor of ice generated and/or stored within icebox compartment 160.

As shown a circulation duct 202 extends within and through icebox compartment 160. Specifically, circulation duct 202 may attach to a portion of icebox liner 132. An air passage 206 is defined by circulation duct 202. For instance, circulation duct 202 may include a duct wall 204 that is attached (e.g., mechanically connected directly or indirectly) to icebox liner 132 to define the separate air passage 206 inside icebox compartment 160. In some embodiment, duct wall 204 includes one or more fins 208, e.g., to increase the surface area of duct wall 204. For example, such fins 208 may extend below the icemaker 152 and/or toward storage bin 154.

Generally, air passage 206 is provided in fluid isolation from icebox compartment 160. In other words, air is not readily exchanged between air passage 206 and icebox compartment 160 (e.g., the surrounding portion of icebox compartment 160, including storage bin 154). Thus, air from freezer chamber 124 will be prevented from interacting with ice formed by icemaker 152 or held within ice storage bin 154. In some embodiments, circulation duct 202, including duct wall 204, is provided as a solid non-permeable member lacking any door or opening in fluid communication with icebox compartment 160. In spite of the fluid isolation, circulation duct 202 may remain in thermal communication (e.g., conductive and/or convective thermal communication) with icebox compartment 160. In turn, heat within icebox compartment 160 may be conducted (e.g., through duct wall 204) into air passage 206. In other words, air within air passage 206 may absorb at least a portion of heat within icebox compartment 160, without passing between air passage 206 and the surrounding portion of icebox compartment 160.

As illustrated, circulation duct 202, specifically air passage 206, is in fluid communication with a separate chilled chamber. In particular, air passage 206 may be in fluid communication with a chilled chamber that houses or encloses an evaporator. For instance, air passage 206 may communicate with freezer chamber 124 within which an evaporator (e.g., evaporator 188A) is mounted. When door 128 is in the closed position, a first opening 212 defined through icebox liner 132 fluidly communicates with the upstream outlet of supply duct 166 while a second opening 214 defined through icebox liner 132 fluidly communicates with the downstream inlet of return duct 168. As shown, the first opening 212 is generally positioned upstream from the second opening 214. Thus, air may be flowed (e.g., as motivated by passage fan 176) from freezer chamber 124 through the supply duct 166 to the air passage 206. From air circulation duct 202, air may further flow through return duct 168 and back to freezer chamber 124. In some embodiments, the first opening 212 is aligned (e.g., vertically) with the supply duct 166 while second opening 214 is aligned with the return duct 168 below the first opening 212.

Figure 5:
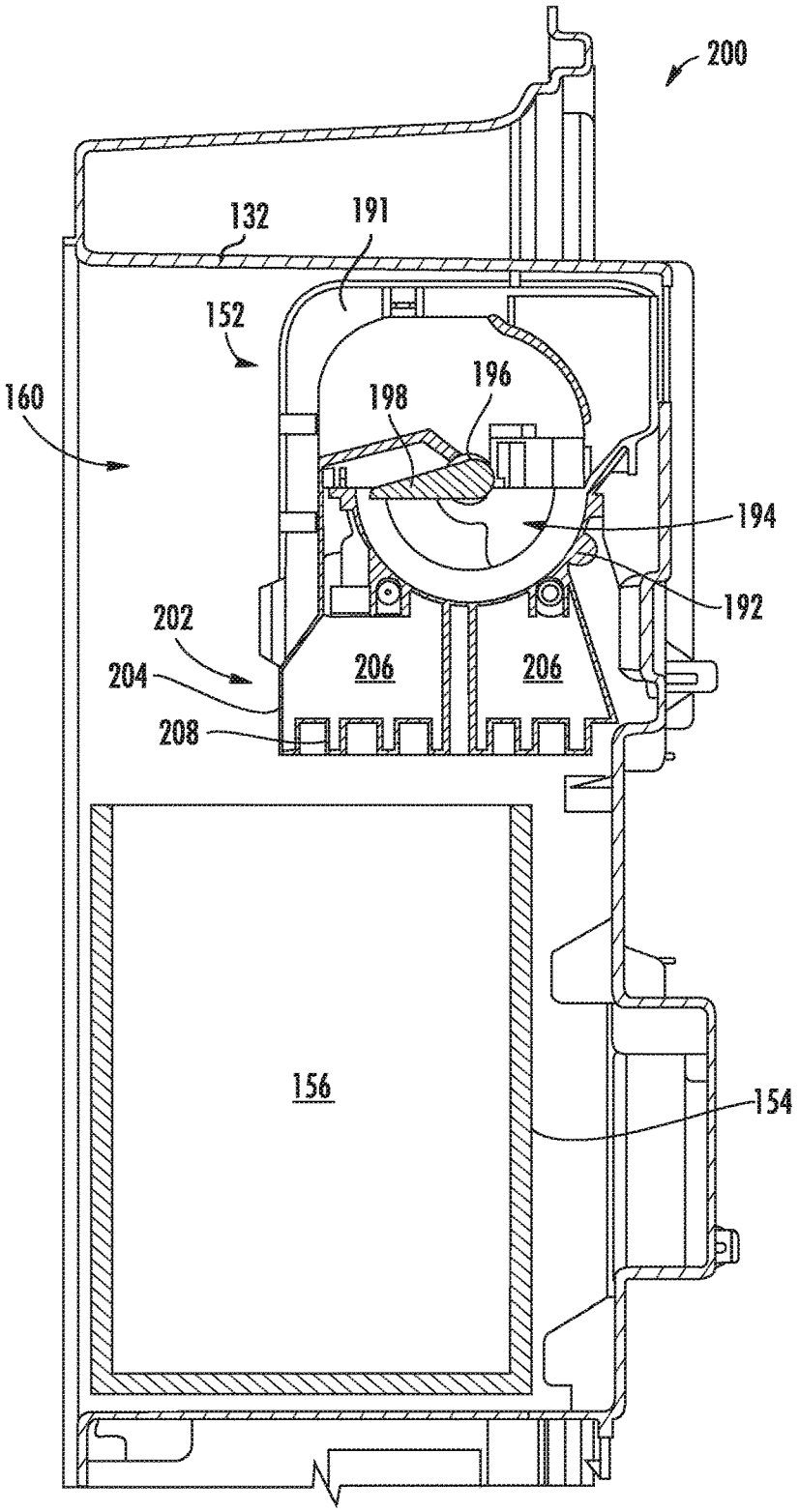
FIG. 5 provides a cross-sectional view of the exemplary cooling system of FIG. 4 taken along the line 5-5.

Turning now to FIGS. 4 through 6, various views of exemplary embodiments of cooling system 200 within a door 128 (FIG. 3) are provided. As shown, icemaker 152 may be mounted within icebox compartment 160. Thus, the icemaker 152 may be disposed at least partially within fresh food chamber 122 (FIG. 3) when door 128 is in the closed position. In some such embodiments, icemaker 152 includes a mold body 192 configured for receiving liquid water and forming ice in the mold body 192. For instance, mold body 192 may be so configured by forming the mold body 192 with a series of impressions or recesses 194 that receive liquid water therein and hold the liquid water at least until the liquid water freezes. In some exemplary embodiments, the icemaker 152 includes features, such as a harvester arm 196 including a plurality of tines 198, for harvesting the ice from the mold body 192. For instance, a motor 191 operably attached (e.g., mechanically fixed) to harvest arm 196 may rotate harvest arm such that the tines 198 are motivated through the impressions or recesses 194. As the tines 198 are rotated, ice cubes formed within the recesses 194 are ejected. Storage bin 154, and in particular storage volume 156, may be disposed in communication with the mold body 192 (e.g., below mold body 192 with an opening directed thereto) for receipt and storage of ice once the ice has been formed in and ejected from mold body 192.

When assembled, icemaker 152 may be in thermal communication with freezer chamber 124 (FIG. 3). As shown, mold body 192 may be mounted to circulation duct 202 (e.g., above duct wall 204). In exemplary embodiments, icemaker 152 may be in conductive thermal communication with circulation duct 202 to cool mold body 192 and permit ice formation therein. Such conductive thermal communication may be provided by contact between duct wall 204 and mold body 192. Additionally or alternatively, one or more attachment brackets (not pictured) may be positioned in contact between duct wall 204 and mold body 192. In certain embodiments, mold body 192 and circulation duct 202 are formed of a material with a high thermal conductivity (e.g., a metal, such as aluminum). In optional embodiments, mold body 192 may be an integral extension of circulation duct 202. In other words, mold body 192 and circulation duct 202 may be formed of a seamless one-piece unitary construction. In additional or alternative embodiments, at least a portion of mold body 192 may be positioned on or within air passage 206. In turn, mold body 192 may be in fluid communication with air passage 206. In some such embodiments, thermal communication between icemaker 152 and freezer chamber 124 (e.g., an evaporator 188A mounted within freezer chamber 124) may be by convection (i.e., air flow) from freezer chamber 124 to circulation duct 202 and/or by conduction from circulation duct 202 to the mold body 192 in the icebox compartment 160. Providing cold air from freezer chamber 124 to circulation duct 202 rather than into icebox compartment 160 may advantageously permit more efficient thermal energy transfer from the cold air to mold body 192. That is, rather than circulating cold air above the mold body 192, impinging a flow of cold air on duct wall 204 or another component that is in direct conductive thermal communication with the mold body 192 allows the cold air to more directly influence the mold body 192. In turn, icemaker 152 may be more efficient and provide faster ice product than conventional approaches. Moreover, any need for insulation surrounding or enclosing icebox compartment 160 may be advantageously reduced.

Turning especially to FIG. 6, some embodiments of cooling system 200 include an icemaker temperature sensor 218 mounted to icemaker 152 (e.g., at mold body 192). Icemaker temperature sensor 218 is configured for measuring a temperature of icemaker 152 and/or liquids, such as liquid water, within mold body 192. Icemaker temperature sensor 218 can be any suitable device for measuring the temperature of icemaker 152 and/or liquids therein. For example, icemaker temperature sensor 218 may be a thermistor or a thermocouple operably coupled (e.g., electrically or wirelessly coupled) to controller 190. Controller 190 may receive a signal, such as a voltage or a current, from icemaker temperature sensor 218 that corresponds to the temperature of the temperature of icemaker 152 and/or liquids therein. In such a manner, the temperature of icemaker 152 (e.g., at mold body 192) and/or liquids therein can be monitored and/or recorded with controller 190.

Generally, passage fan 176 may be mounted at a suitable location along the fluid path between freezer compartment 124 (FIG. 3) and circulation duct 202 to recirculate air through air passage 206. For instance, passage fan 176 may be mounted to or within circulation conduit 202, supply conduit 166, or return duct 168 (FIG. 3). Optionally, passage fan 176 may be positioned upstream from icemaker 152 (i.e., upstream from the portion of circulation duct 202 in conductive communication with the icemaker 152 and/or mold body 192).

In some embodiments, controller 190 is configured to activate (e.g., rotate) passage fan 176 based, at least in part, on a temperature detected at icemaker temperature sensor 218 mounted on icemaker 152. Any suitable algorithm that includes temperature of the icemaker 152 and, optionally, an elapsed time period. As the demand for cool air increases (e.g., during ice making operations in which the temperature of the icemaker 152 rises above a threshold value), passage fan 176 may be activated to circulate air within icebox compartment 160.

As illustrated, certain embodiments include at least one passage fan 176 in fluid communication with air passage 206 and at least one air handler, such as a compartment blower or fan 226, in fluid communication with icebox compartment 160. One or both of the fans 176, 226 may be operably coupled (e.g., electrically or wirelessly coupled) to controller 190.

Compartment fan 226 may be mounted at a suitable location within icebox compartment 160 to recirculate air therein (i.e., outside of and apart from air passage 206). Compartment fan 226 may thus be operable to motivate air circulation within the icebox compartment 160 (e.g., as directed by controller 190). In particular, compartment fan 226 may circulate air about mold body 192 and/or storage bin 154. Furthermore, compartment fan 226 may circulate air over an outer surface the duct wall 204 of circulation duct 202 (i.e., outside of air passage 206). For instance, compartment fan 226 may be mounted adjacent to circulation duct 202 (e.g., below icemaker 152) and directed toward circulation duct 202, advantageously increasing the convective heat transfer between icebox compartment 160 and circulation duct 202. Such air circulation may be advantageous to assist in chilling the icebox compartment 160 and keeping ice therein at a desired temperature (e.g., below 32° Fahrenheit).

In optional embodiments, a compartment temperature sensor 228 may be positioned or mounted within icebox compartment 160. For instance, may be spaced apart from circulation duct 202 and outside of air passage 206. Compartment temperature sensor 228 is configured for measuring a temperature of icebox compartment 160 and/or storage bin 154 (e.g., for ice cubes within storage volume 156). Compartment temperature sensor 228 can be any suitable device for measuring the temperature of icebox compartment 160 and/or ice cubes therein. For example, compartment temperature sensor 228 may be a thermistor or a thermocouple operably coupled (e.g., electrically or wirelessly coupled) to controller 190. Controller 190 may receive a signal, such as a voltage or a current, from compartment temperature sensor 228 that corresponds to the temperature of the temperature of icebox compartment 160 and/or storage bin 154. In such a manner, the temperature of storage bin 154 and/or storage volume 156 can be monitored and/or recorded with controller 190.

In some embodiments, controller 190 is configured to activate compartment fan 226 (i.e., initiate rotation of compartment fan 226) based on one or more criteria. For instance, activation may be based on a temperature signal from compartment temperature sensor 228. As the temperature rises above a threshold value, compartment fan 226 may be activated to circulate air within icebox compartment 160. In additional or alternative embodiments, controller 190 may be configured to activate compartment fan 226 when the ice storage bin 154 is full and ice making is not required. In some such embodiments, cold air may not be provided to circulation duct 202 from freezer chamber 124 when ice making is not required, and therefore compartment fan 226 may be activated to ensure heat does not accumulate in one or more distinct portions of icebox compartment 160.

As noted above, controller 190 may be configured to activate passage fan 176 based, at least in part, on a temperature detected at the icemaker temperature sensor 218. Controller 190 may thus activate compartment fan 226 independently or separately from passage fan 176. Advantageously, icebox compartment 160 and storage bin 154, including storage volume 156, may be cooled or maintained at a unique temperature, distinct from the temperature of icemaker 152 and mold body 192.

Figure 8:
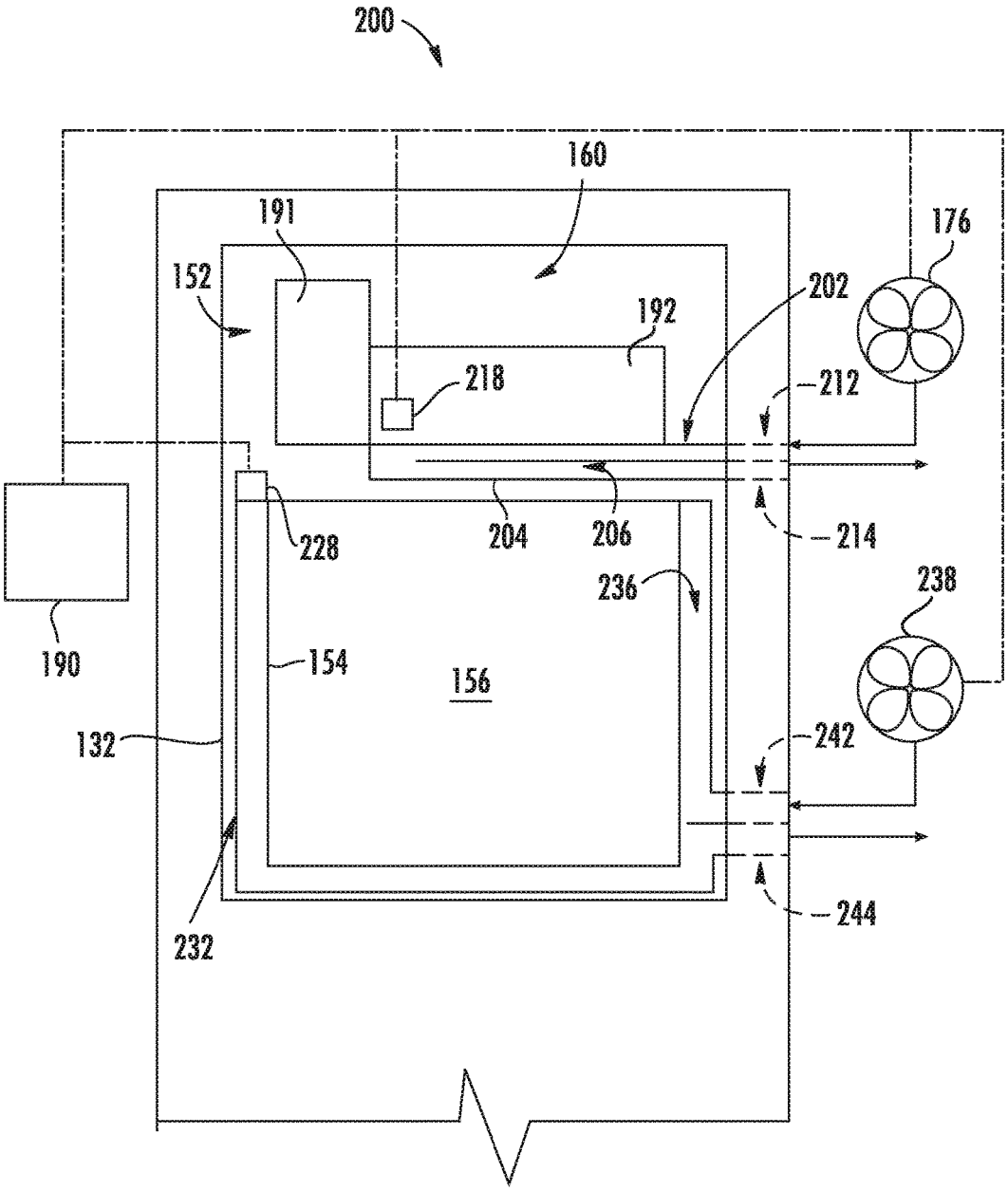
FIG. 8 provides a schematic view of another cooling system in a refrigerator door of an exemplary refrigerator appliance according to exemplary embodiments of the present disclosure.

Turning now to FIG. 8, an alternative embodiment of icebox compartment 160 is illustrated. It is understood that, the embodiment of FIG. 8 is similar to the embodiments described above with respect to FIGS. 1 through 7. Specifically, the embodiments of FIG. 8 may include one or all of the above-described features of the embodiments of FIGS. 1 through 7, except as otherwise indicated. For instance, in the exemplary embodiments of FIG. 8, a second circulation duct 232 extends through at least a portion of icebox compartment 160 and defines a second air passage 236. Circulation duct 202 is thus provided as a first circulation duct defining a first air passage 206. Moreover, passage air fan 176 may be a first passage air fan.

As shown, second circulation duct 232 may be in thermal communication (e.g., conductive thermal communication) with storage bin 154. Optionally, second circulation duct 232 may be formed along (e.g., as an integral unitary member with) storage bin 154. Alternatively, circulation duct 202 may be fixed to a portion of icebox liner 132. Storage bin 154 may be removable from icebox compartment 160. However, when positioned within icebox compartment 160, storage bin 154 may be disposed (e.g., removably disposed) on the second circulation duct 232 in contact and conductive thermal communication therewith.

Generally, second air passage 236 is provided in fluid isolation from icebox compartment 160. In other words, air is not readily exchanged between second air passage 236 and icebox compartment 160 (e.g., the surrounding portion of icebox compartment 160, including storage bin 154). Second circulation duct 232 may be provided as a solid non-permeable member lacking any door or opening in fluid communication with icebox compartment 160. In spite of the fluid isolation, however, second circulation duct 232 may remain in thermal communication (e.g., conductive thermal communication) with storage volume 156. In turn, heat within storage volume 156 may be conducted (e.g., through storage bin 154) into second air passage 236. In other words, air within second air passage 236 may absorb at least a portion of heat within storage volume 156, without passing between second air passage 236 and the surrounding portion of icebox compartment 160.

As illustrated, air may be flowed through second circulation duct 232 between a first opening 242 and a second opening 244. Air may generally circulate between second air passage 236 and a remote chilled chamber. For instance, in certain embodiments, second air passage 236 is in fluid communication with freezer chamber 124 (FIG. 3) to exchange air therewith, similar to the first air passage 206. In alternative embodiments, second air passage 236 is provided in fluid communication with another chilled evaporator chamber (not pictured), separate and discrete from freezer chamber 124 (FIG. 3).

A separate supply duct and/or return duct (not pictured) may be provided in fluid communication between second circulation duct 232 and the remote chilled chamber (e.g., freezer chamber 124—FIG. 3). Alternatively, an intermediate duct may fluidly connect the second opening 214 of the first circulation duct 202 to the downstream first opening 242 of the second circulation duct 232. In such embodiments, however, a discrete valve or flap may be provided to selectively direct air (e.g., from the first circulation duct 202 to the second circulation duct 232 or, alternately, to the freezer chamber 124). Generally, air through or within second circulation duct 232 may be flowed separately from the air within or flowing through first circulation duct 202. In some embodiments, a second passage fan 238 is provided to motivate and recirculate air through second circulation duct 232 (e.g., independently of the air motivated by the first passage fan 176). Thus, air may be motivated by second passage fan 238 through second air passage 236 (e.g., from freezer chamber 124), regardless of whether the first passage fan 176 is activated.

In optional embodiments, a compartment temperature sensor 228 may be positioned or mounted within icebox compartment 160. For instance, may be spaced apart from first circulation duct 202 and outside of air passage 206. As illustrated in FIG. 8, compartment temperature sensor 228 may be mounted to second circulation duct 232 (e.g., outside of the second air passage 236).

Compartment temperature sensor 228 is configured for measuring a temperature of icebox compartment 160 and/or storage bin 154 (e.g., for ice cubes within storage volume 156). Compartment temperature sensor 228 can be any suitable device for measuring the temperature of icebox compartment 160 and/or ice cubes therein. For example, compartment temperature sensor 228 may be a thermistor or a thermocouple operably coupled (e.g., electrically or wirelessly coupled) to controller 190. Controller 190 may receive a signal, such as a voltage or a current, from compartment temperature sensor 228 that corresponds to the temperature of the temperature of icebox compartment 160, storage bin 154, and/or second circulation duct 232. In such a manner the temperature of storage bin 154, storage volume 156, and/or second circulation duct 232 can be monitored and/or recorded with controller 190.

In some embodiments, controller 190 is configured to activate second passage fan 238 (i.e., initiate rotation of second passage fan 238) based on one or more criteria. For instance, activation may be based on a temperature signal from compartment temperature sensor 228. As the temperature rises above a threshold value, second passage fan 238 may be activated to circulate air within second air passage 236. In additional or alternative embodiments, controller 190 may be configured to activate second passage fan 238 when ice making is not required. In some such embodiments, cold air may not be provided to circulation duct 202 from freezer chamber 124 when ice making is not required, and therefore second passage fan 238 may be activated to ensure heat does not accumulate or melt ice within storage volume 156. Additionally or alternatively, controller 190 may be configured to restrict or limit the flow of air through second air passage 236 when ice making is required and first passage fan 176 is active (i.e., rotating). Thus, controller 190 may ensure storage volume 156, as well as ice therein, is not excessively cooled.

As noted above, controller 190 may be configured to activate first passage fan 176 based, at least in part, on a temperature detected at the icemaker temperature sensor 218. Controller 190 may thus activate second passage fan 238 independently or separately from first passage fan 176. Advantageously, second air passage 236 and storage volume 156 may be cooled or maintained at a unique temperature, distinct from the temperature of icemaker 152 and mold body 192.

Figure 9:
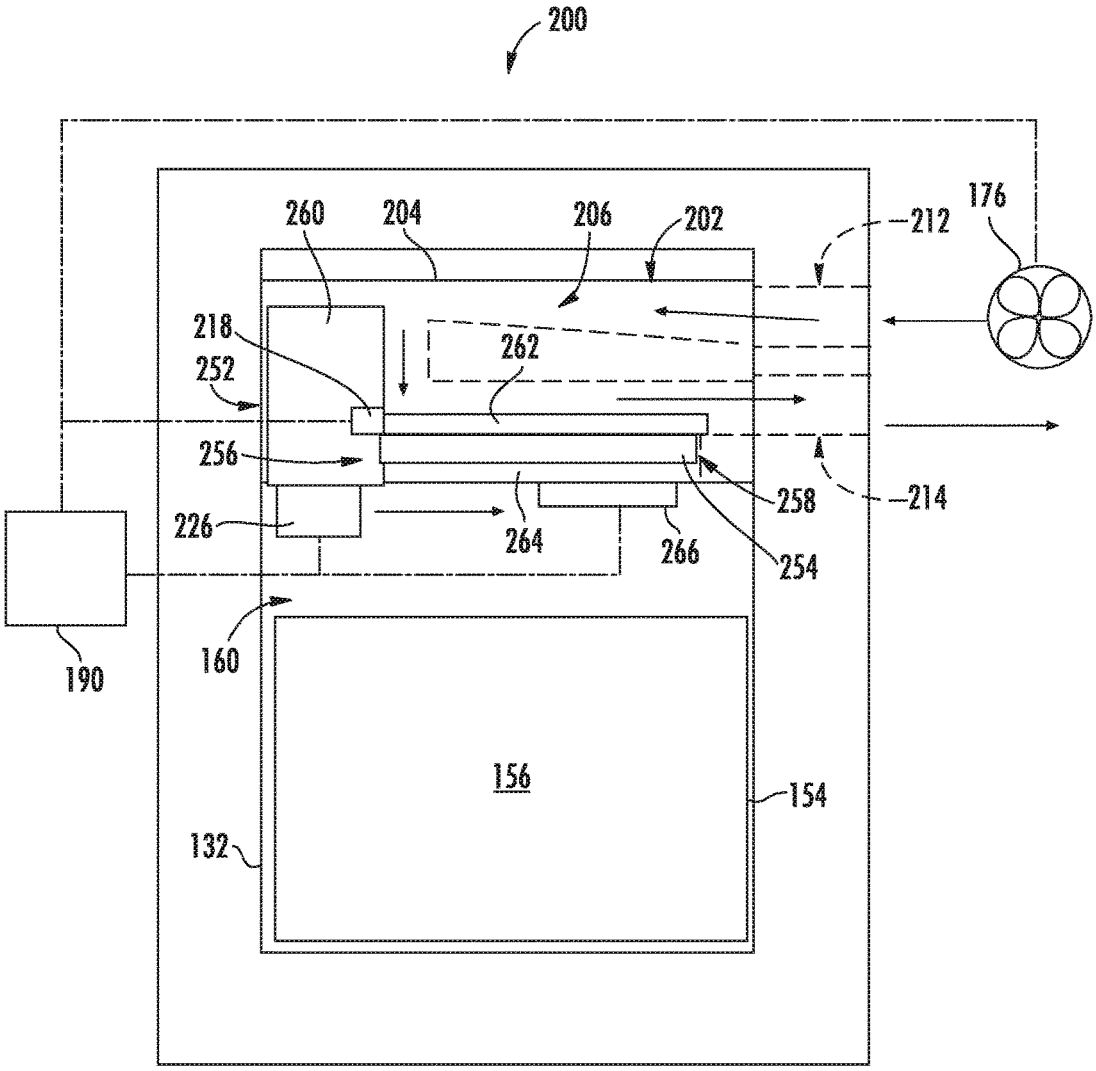
FIG. 9 provides a schematic view of yet another cooling system in a refrigerator door of an exemplary refrigerator appliance according to exemplary embodiments of the present disclosure.

Turning now to FIG. 9, an alternative embodiment of icebox compartment 160 is illustrated. It is understood that, the embodiment of FIG. 9 is similar to the embodiments described above with respect to FIGS. 1 through 7 and/or and FIG. 8. Specifically, the embodiments of FIG. 9 may include one or all of the above-described features of the embodiments of FIGS. 1 through 7 and/or FIG. 8, except as otherwise indicated. For instance, in the exemplary embodiments of FIG. 9, may include a twist tray icemaker 252. Thus, in order to loosen ice cubes within cavities from mold body 254, mold body 254 can be twisted. Specifically a motor 260 can urge a first end portion 256 (e.g., a portion proximal to motor 260) of mold body 254 to rotate. During such rotation of first end portion 256 of mold body 254, a second end portion 258 (e.g., a portion distal to motor 260) of mold body 254 can remain stationary, fixed, or rotated less than first end portion 256 of mold body 254. In such a manner, mold body 254 can twist and, e.g., loosen or dislodge ice cubes from mold body 254. An ejector frame 262 (i.e., a fixed ejector element mounted to an included support frame) may be positioned adjacent to and above mold body 254 and is configured for assisting with removal of ice from cavities of mold body 254. Thus, as motor 260 rotates mold body 254, ejector frame 262 can remain stationary or fixed and direct removal of ice from cavities of mold body 254.

In exemplary embodiments, circulation duct 202 includes a duct wall 204 that encloses at least a portion of icemaker 252. As described above, circulation duct 202 may define an air passage 206 fluidly isolated from storage volume 156. Some or all of mold body 254 and/or ejector frame 262 may be positioned within air passage 206. Moreover, duct wall 204 may be formed as a conductive body that, optionally, includes one or more corrugated or finned segments to increase the surface area and rate of heat transfer through duct wall 204 (i.e., the rate of heat exchange between air passage 206 and the surrounding portion of icebox compartment 160). As illustrated, air may be flowed through air passage 206 above ejector frame 262 (e.g., as motivated by passage fan 176).

In some embodiments, duct wall 204 includes a conductive movable portion, such as a sealed door 264, that is positioned below mold body 254. Sealed door 264 may be configured for movement (e.g., rotating or sliding movement) to selectively move between a closed position in which access to mold body 254 is restricted and an open position in which access to mold body 254 is permitted. Along with preventing or restricting access to mold body 254, in the closed position sealed door 264 may hermetically air passage 206 from the surrounding portion of icebox compartment 160, as well as storage volume 156. In the open position, sealed door 264 may allow, for example, ice cubes to pass therethrough. Thus, as mold body 254, sealed door 264 may be moved to the open position, thereby permitting ice cubes to be ejected from icemaker 252 and into storage volume 156.

As described above, some embodiments of cooling system 200 include an icemaker temperature sensor 218 mounted to icemaker 252 (e.g., at mold body 254 or ejector frame 258). Icemaker temperature sensor 218 is configured for measuring a temperature of icemaker 252 and/or liquids, such as liquid water, within mold body 254. Icemaker temperature sensor 218 can be any suitable device for measuring the temperature of icemaker 252 and/or liquids therein. For example, icemaker temperature sensor 218 may be a thermistor or a thermocouple operably coupled (e.g., electrically or wirelessly coupled) to controller 190. Controller 190 may receive a signal, such as a voltage or a current, from icemaker temperature sensor 218 that corresponds to the temperature of the temperature of icemaker 252 and/or liquids therein. In such a manner, the temperature of icemaker 252 (e.g., at mold body 254 or ejector frame 258) and/or liquids therein can be monitored and/or recorded with controller 190.

Optionally, a defrost heater 266, such as a resistive heating element, may be mounted to circulation duct 202 (e.g., in contact with duct wall 204 and/or outside of air passage 206) to selectively melt frost formed on, for example, duct wall 204. In some such embodiments, defrost heater 266 may be operably coupled (e.g., electrically or wireless coupled) to controller 190. Controller 190 may be configured to activate defrost heater 266, for instance, based on a temperature detected at temperature sensor 218, or a separate temperature sensor mounted at a suitable location on duct wall 204.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance comprising:

a cabinet defining a first chilled chamber and a second chilled chamber spaced apart from the first chilled chamber;

an icebox liner attached to the cabinet, the icebox liner defining a sub-compartment within the first chilled chamber;

an icemaker mounted within the sub-compartment;

an ice bin defining a storage volume within the sub-compartment to receive ice from the icemaker; and a circulation duct extending within the sub-compartment in conductive thermal communication with the icemaker, the circulation duct defining an air passage in fluid communication with the second chilled chamber and fluid isolation from the storage volume such that air is not readily exchanged between the air passage and the storage volume, wherein the circulation duct is a first circulation duct defining a first air passage, and wherein the refrigerator appliance further comprises a second circulation duct extending within the sub-compartment in conductive thermal communication with the storage bin, the second circulation duct defining a second air passage in fluid isolation from the storage volume such that air is not readily exchanged between the second air passage and the storage volume.

2. The refrigerator appliance of claim 1, further comprising an icemaker temperature sensor mounted to the icemaker.

3. The refrigerator appliance of claim 1, further comprising a passage fan in fluid communication with the air passage to motivate air therethrough.

4. The refrigerator appliance of claim 1, further comprising a compartment fan mounted within the sub-compartment to motivate therethrough.

5. The refrigerator appliance of claim 4, further comprising:

a compartment temperature sensor mounted within the sub-compartment and spaced apart from the circulation duct; and a controller operably coupled to the compartment fan and the compartment temperature sensor, wherein the controller is configured to initiate rotation of the compartment fan based on a temperature signal received from the compartment temperature sensor.

6. The refrigerator appliance of claim 1, further comprising:

a first passage fan in fluid communication with the first air passage to motivate air therethrough; and a second passage fan in fluid communication with the second air passage to motivate air therethrough.

7. The refrigerator appliance of claim 6, further comprising a compartment temperature sensor mounted within the sub-compartment and spaced apart from the first circulation duct.

8. The refrigerator appliance of claim 7, further comprising a controller operably coupled to the second passage fan and the compartment temperature sensor, wherein the controller is configured to initiate rotation of the second passage fan based on a temperature signal received from the compartment temperature sensor.

9. The refrigerator appliance of claim 1, wherein the storage bin is removably disposed on the second circulation duct in thermal communication therewith.

10. A refrigerator appliance comprising:

a cabinet defining a fresh food chamber and a chilled evaporator chamber;

an evaporator mounted within the chilled evaporator chamber;

an icebox liner attached to the cabinet at the fresh food chamber, the icebox liner defining a sub-compartment;

an icemaker mounted within the sub-compartment;

an ice bin defining a storage volume within the sub-compartment to receive ice from the icemaker; and a circulation duct extending within the sub-compartment in conductive thermal communication with the icemaker, the circulation duct defining an air passage in fluid communication with the chilled evaporator chamber and fluid isolation from the storage volume such that air is not readily exchanged between the air passage and the storage volume.

11. The refrigerator appliance of claim 10, further comprising an icemaker temperature sensor mounted to the icemaker.

12. The refrigerator appliance of claim 10, further comprising a passage fan in fluid communication with the air passage to motivate air therethrough.

13. The refrigerator appliance of claim 10, further comprising a compartment fan mounted within the sub-compartment to motivate therethrough.

14. The refrigerator appliance of claim 13, further comprising:

a compartment temperature sensor mounted within the sub-compartment and spaced apart from the circulation duct; and a controller operably coupled to the compartment fan and the compartment temperature sensor, wherein the controller is configured to initiate rotation of the compartment fan based on a temperature signal received from the compartment temperature sensor.

15. The refrigerator appliance of claim 10, wherein the circulation duct is a first circulation duct defining a first air passage, and wherein the refrigerator appliance further comprises a second circulation duct extending within the sub-compartment in conductive thermal communication with the storage bin, the second circulation duct defining a second air passage in fluid isolation from the storage volume such that air is not readily exchanged between the second air passage and the storage volume.

16. The refrigerator appliance of claim 15, further comprising:

a first passage fan in fluid communication with the first air passage to motivate air therethrough; and a second passage fan in fluid communication with the second air passage to motivate air therethrough.

17. The refrigerator appliance of claim 16, further comprising a compartment temperature sensor mounted within the sub-compartment and spaced apart from the first circulation duct.

18. The refrigerator appliance of claim 17, further comprising a controller operably coupled to the second passage fan and the compartment temperature sensor, wherein the controller is configured to initiate rotation of the second passage fan based on a temperature signal received from the compartment temperature sensor.

19. The refrigerator appliance of claim 15, wherein the storage bin is removably disposed on the second circulation duct in thermal communication therewith.

20. A refrigerator appliance comprising:

a cabinet defining a first chilled chamber and a second chilled chamber spaced apart from the first chilled chamber;

an icebox liner attached to the cabinet, the icebox liner defining a sub-compartment within the first chilled chamber;

an icemaker mounted within the sub-compartment;

an ice bin defining a storage volume within the sub-compartment to receive ice from the icemaker;

a circulation duct extending within the sub-compartment in conductive thermal communication with the icemaker, the circulation duct defining an air passage in fluid communication with the second chilled chamber and fluid isolation from the storage volume such that air is not readily exchanged between the air passage and the storage volume;

a compartment fan mounted within the sub-compartment to motivate therethrough;

a compartment temperature sensor mounted within the sub-compartment and spaced apart from the circulation duct; and a controller operably coupled to the compartment fan and the compartment temperature sensor, wherein the controller is configured to initiate rotation of the compartment fan based on a temperature signal received from the compartment temperature sensor.

* * * * *